US007004504B1

(12) United States Patent
Paulovits, Jr.

(10) Patent No.: US 7,004,504 B1
(45) Date of Patent: Feb. 28, 2006

(54) METHOD FOR SKATE BOARD IDENTIFICATION

(76) Inventor: Gabor Paulovits, Jr., 2160 W. Ave. 135th, San Leandro, CA (US) 94577

( * ) Notice: Subject to any disclaimer, the term of this patent is extended or adjusted under 35 U.S.C. 154(b) by 130 days.

(21) Appl. No.: 10/665,659

(22) Filed: Sep. 19, 2003

(51) Int. Cl.
*A63C 17/26* (2006.01)

(52) U.S. Cl. ..... 280/809; 280/87.042; 301/5.301

(58) Field of Classification Search ..... 280/87.01, 280/87.021, 87.041, 87.042, 809, 825, 811; 301/5.301, 108.1, 108.3
See application file for complete search history.

(56) References Cited

U.S. PATENT DOCUMENTS 2,392,634 A * 1/1946 Bierman ..... 301/5.301
2,606,791 A * 8/1952 Specht ..... 301/5.7
3,883,180 A * 5/1975 Kain ..... 301/5.306
4,364,187 A * 12/1982 Melendez ..... 36/15
4,408,803 A * 10/1983 Green et al. ..... 301/5.7
4,511,182 A * 4/1985 Birnbaum ..... 301/37.42
4,962,968 A * 10/1990 Caplin ..... 301/108.5
5,058,959 A * 10/1991 Miles et al. ..... 301/108.2
5,290,065 A * 3/1994 Kassal ..... 280/825
5,522,621 A * 6/1996 Schneider ..... 280/825
6,164,729 A * 12/2000 Dibenedetto et al. .... 301/5.304
6,454,361 B1 * 9/2002 Martin ..... 301/5.301
2004/0108768 A1 * 6/2004 Weiss et al. ..... 301/5.301
2004/0124627 A1 * 7/2004 Cuerrier ..... 280/809

* cited by examiner

*Primary Examiner*—Jeff Restfio
(74) *Attorney, Agent, or Firm*—Quine Intellectual Perperty Law Group, P.C.; Gary Baker

(57) ABSTRACT

A cover designed to accommodate the unique shape of a wheel for a skate board. In one embodiment, the cover snaps onto the wheel. In another embodiment, security of the cover to the wheel by an adhesive gasket. Various patterns are punched into the cover providing distinguishing decorative characteristics.

6 Claims, 2 Drawing Sheets

METHOD FOR SKATE BOARD IDENTIFICATION

FIELD OF THE INVENTION

This invention relates to covers for wheels of skate boards and particularly to a method for adapting the use of wheel covers to customizing, individualizing and identifying ownership of a skate board.

BACKGROUND AND INFORMATION DISCLOSURE

There are presently about ten million skateboarders in the United States. This is more than a 100% increase since 1995. Skateboarding is particularly popular among the age group from 13 to 21 among which a common interest in the activity is effective in congregating the participants in groups. The groups have any one of a number or reasons for gathering including popularity of particular locations where a feature such as a hill, a slant board, a tunnel, whose navigation on a skate board presents a challenge to the skate boarder. Contests have been organized in which participants perform a program of stunts in competition with fellow skate boarders and "extreme sports enthusiasts. Some contests are extensively advertised, presented on television and winners awarded substantial prizes.

These contests share a common characteristic with certain other extreme sports such as diving, figure (ice) skating, ballroom dancing, etc., in that physical features of the participant or decorative features of attire or equipment subconsciously influence the outcome in determining the winner.

Even among groups of skate boarders that have assembled solely for joint skateboard sessions, distinguishing features of equipment are desired from the standpoint that they attract interest and promote social intercourse among the participants.

Another consideration related to features of skateboard equipment is the association of the equipment with a specific manufacturer of the equipment. (Everyone is familiar with the value of labeling athletic shoes with the word "NIKE") However, attaching a label to a skate board poses the problem of durability and convenience. If a label bearing indicia or logo is attached to the surface of the platform, then the label is exposed to eventual displacement by virtue of the athlete's foot abrading the surface of the board. Furthermore, the label does not "standout" to a spectator viewing the skateboarder from the side.

Yet another problem associated with skateboarding is the problem of identification. Skateboards generally all look alike, When skateboarders mix an mingle in a skate board outing with other skateboarders, he appreciates having a permanent indestructible feature that distinguishes his skate board from all of the other skateboards to minimize the chance that his skate board will become lost because it was mixed in with a large group of other skate boards.

Skate boards are generally constructed having a rectangular platform supported on four wheels arranged in quadrature positions. FIG. 1 A is a plan view and FIG. 1 B is a sectional edge view (prior art) showing the wheel 10 of a skateboard (not shown) that has been widely adapted by the industry.

Sectional view FIG. 1B shows the outer surface of the wheel 10 for skate boards having a cylindrical tread section 12 and a convex section 14 so that the tread 12 of the wheel 10 is narrower than the thickness of the wheel closer to the center of the wheel. The wheel has a bore 16. A shoulder 18 in the bore 16 supports a bearing and retaining nut (not shown) on the threaded end of the wheel axle (not shown).

The wheel for in-line rollerskates described in the cited art and shown in FIG. 2 has a square cross section as shown in cross section in FIG. 2, The shape is different from the skate board wheel discussed with reference to FIGS. 1A, B.

A number of disclosures have appeared directed toward wheel covers for in-line skates and roller skates.

For example, U.S. Pat. No. 4,511,182 to Birnham discloses a flat cover that is retained in place on the flat surface of a skate wheel by an elastomeric sleeve that slips onto the steel shaft.

U.S. Pat. No. 4,962,968 to Calpis discloses a flat cover having protuberance that engages the wheel retaining nut on the wheel axle.

U.S. Pat. No. 3,883,180 discloses a cover for a wheel having a square cross section wherein the cover extends over the entire side surface of the wheel and I engaged to the wheelaxle.

U.S. Pat. No. 2,392,634 discloses a cover adapted to fit into a recess on a side surface of a wheel having a square cross section. The wheel cover is mounted into the recess with a spanning wrench.

None of the covers disclosed in the cited art are designed for adaptation to the skate board wheel of FIGS. 1 A,B.

As shown in FIG. 2, the wheel 11 for in-line skates has a thickness, T, measured at the axle 13 that is the same as the thickness of the wheel measured at the periphery. Consequently, the outer surface of the wheel is flat. Since the cover 15 for the skate wheel of the cited art is simply a flat disk, there is nothing particularly outstanding about the appearance of the covers on these wheels that creates a lasting impression.

SUMMARY OF THE INVENTION

It is an object of this invention to provide a cover for a skateboard wheel wherein the cover has outstanding features that distinguish the skateboard from other skate boards. It is especially contemplated to provide a cover that is shaped for accommodation to the skateboard wheel having the typical convex outer surface.

It is a further object that the cover has features that distinguish it from other skateboard wheels so that ownership of the skateboard is readily determined. In this regard it is contemplated that the features cannot be erased or do not wear out.

This invention is directed toward a cover for a skate board that is a plate having an outer circular periphery and an inner circular opening concentric with the periphery. The plate has a face that is convex in a direction away from the wheel and dimensioned/shaped to fit in full contact with the outer convex surface of the skate board wheel.

In one embodiment, The circular area surrounding the inner opening has a neck dimensioned and shaped to permit pressing the neck of the cover into the shouder of the wheel bore thereby securing the cover to the convex wheel surface.

In another embodiment, a flat circular gasket is positioned between the outer surface of the wheel and inner surface of the cover. The gasket has an adhesive coating on both sides so that the cover is firmly secured against the outer convex surface of the skateboard wheel.

In one embodiment, an important feature is that the cover is thin metal and a circular array of openings is arranged around the surface of the cover. The openings, formed in a punching operation, cannot be removed nor can they be readily be duplicated so that the owner of the skateboard can easily distinguish his skate board from other skateboard that doe not have the identical wheel covers. This is a valuable feature for identification purposes.

The foregoing summary has highlighted features, aspects and advantages of the present invention. The invention is further explained by the following description of what I presently believe to be the best mode for carrying out the invention illustrated by drawings to which are appended claims which define the scope of the invention.

DESCRIPTION OF A BEST MODE

Figure 1A:
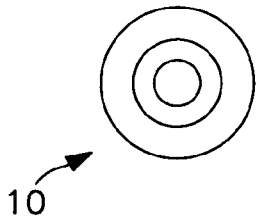
FIG. 1A PRIOR ART
FIGS. 1A and 1B (prior art) show the typical skate board wheel to which the cover of the present invention is secured.
Figure 1B:
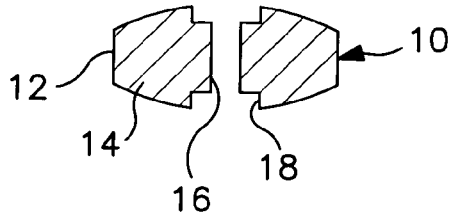
FIG. 1B PRIOR ART
Figure 2A:
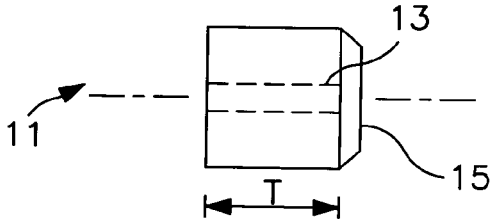
FIG. 2A PRIOR ART
FIG. 2 shows the typical square wheel used on skates.

Turning now to a discussion of the drawings, FIGS. 1A, B (prior art) show the typical skate board wheel 10 having the cylindrical tread area 12 and the convex surfaces 14 as discussed above. The narrow tread promotes greater control of the skate board (such as shorter turn radius) while the thicker section closer to the axle of the wheel provides greater bearing strength. at the axle.

Figure 3A:
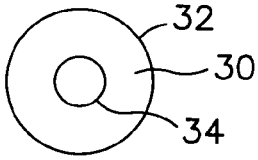
FIGS. 3 A–C show the wheel cover of this invention.
Figure 3B:
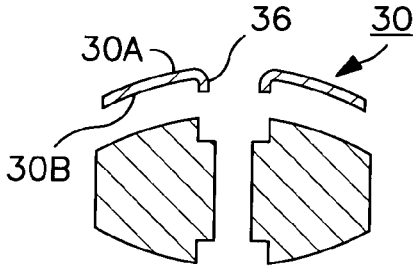

FIG. 3A is a plan view of the invention. FIG. 3B is a sectional view of the cover of this invention poised for mounting on the skateboard wheel of FIGS. 1A, B.

Figure 3C:
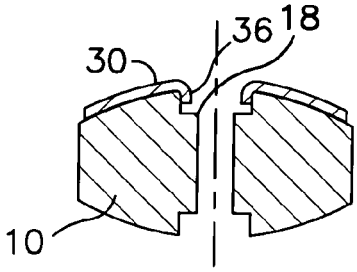

There is shown a plate 30 bounded by a circular outside edge 32 and a circular inside edge 34 concentric with said circular outside edge. The plate 30 has a shape with a convex face 30A that is convex in a convex direction opposite a concave face 30B. The plate has a circular neck region 36 extending in a direction opposite the convex direction. The shape of the plate and neck is dimensioned in operable combination with the wheel 10 such that the cover 30 is securely positionable with the concave surface 30B of the plate flush 30 against the front surface 10A of the wheel 10 and the neck 36 is press fitted inside the shoulder 18 as shown in FIG. 3C. The diameter of the "neck" portion 36 is dimensioned so that the cover 30 is secured to the wheel 10 by a press fit of inner neck portion 36 into the recess formed by the shouder 18.

Figure 4:
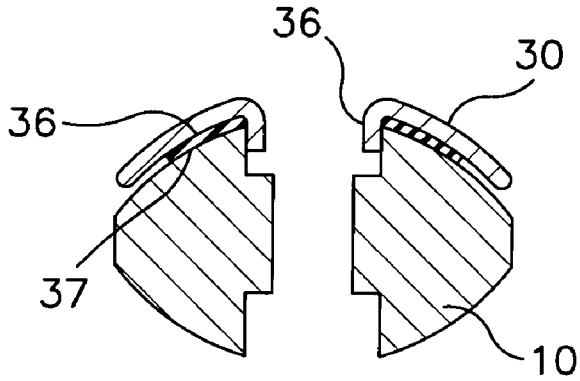
FIG. 4 shows an adhesive gasket between wheel and cover.

FIG. 4 shows the cover 30 mounted on the wheel 10 with an adhesive gasket 37 interposed between the cover and the outer surface of the wheel 10.

The cover 30 is preferably a thin metal having a thickness range of between 0.010 to 0.030 inches thick. In another version, the cover is a polymer.

Figure 5:
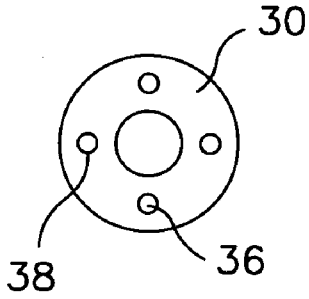
FIG. 5 shows a unique design for the cover of this invention.
Figure 6:
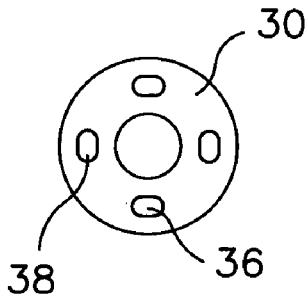
FIG. 6 shows a unique design for the cover of this invention.
Figure 7:
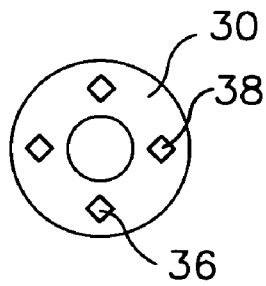
FIG. 7 shows a unique design for the cover of this invention.

FIGS. 5, 6 and 7 show an embodiment of the cover wherein a circular array of apertures 38 are punched into the cover 30. Various patterns are used to distinguish one set of skateboards from one another. FIG. 5 shows an array of circular apertures. FIG. 6 shows an array of oblong slots. FIG. 7 shows a circular array of diamonds, etc. As discussed above, the differences in the array patterns serves the very useful purpose of enabling the user to distinguish his/her skate board from other skate boards. thus preventing a mix up resulting in the skateboarder from walking off with the wrong skateboard.

There has been described a cover for the wheels of skate boards which meets the objects of this invention.

On object has been that the covers be convenient to mount on the wheel.

Another object is that the wheel be demountable from the axle of the skate board without the necessity of separating the wheel from the wheel cover.

These objects were accomplished by providing a cover that conforms closely to the convex contour of the skateboard wheel surface including a neck that press fits into the concentric recess in the wheel. Security of the mount is enhanced by use of an adhesive gasket between the inside surface of the cover and the outside surface of the wheel.

Another object is that markings be formed on the wheel that would not be conveniently possible to remove or disguise thereby providing a convenient means of identification. This object was accomplished by punching or embossing an array of distinctive designs into the metal cover.

Variations and modifications of the invention may be contemplated after reading the specification and studying the drawings that are within the scope of the invention. I therefore wish to define the scope of my invention by the appended claims.

What is claimed is:

1. A cover for a wheel for a skateboard, said wheel having a cylindrical tread surface joined to convex surfaces on opposite sides of the wheel and concentric with a bore, said bore having a shoulder on esch end of the bore arranged to support a bearing and retaining nut mounted on an axle positioned through said bore, wherein said cover comprises:

a plate bounded by a circular outside edge and a circular inside edge concentric with said circular outside edge, said plate having a shape that is convex in a convex direction opposite a concave face;

said plate having a circular neck region bounded by said inside edge and extending in a direction opposite said convex direction;

said shape of said plate and said neck dimensioned in operable combination with said wheel to provide that said cover be securely positionable with said concave surface flush against said convex surface of said wheel and said neck press fitted inside said shoulder;

said plate having a plurality of apertures arranged in a circle concentrically around said neck region, a gasket being a flat ring with an inside diameter and outside diameter having an adhesive composition coating on both sides of said gasket;

said gasket arranged for positioning between said convex surface of said wheel and said concave surface of said plate whereby security of said cover flush against said front surface of said wheel is enhanced.

2. The cover of claim 1 wherein said plate is one of a resilient metal alloy and polymer.

3. The cover of claim 1 wherein said plate has a thickness selected from a range of thickness from 0.01 inches to 0.030 inches.

4. The cover of claim 1 wherein each aperture of said array of apertures has a shape selected from a group of shapes consisting of a diamond, a circle, an oblong slot, a square, a rectangle.

5. A cover for a wheel for a skateboard, said wheel having a cylindrical tread surface joined to convex surfaces on opposite sides of the wheel and concentric with a bore, a shoulder arranged to support a bearing and retaining nut mounted on an axle positioned through said bore, wherein said cover comprises:

a plate bounded by a circular outside edge and a circular inside edge concentric with said circular outside edge;

said plate having a shape that is convex in a convex direction opposite a concave face;

said plate having a circular neck region bounded by said inside edge and extending in a direction opposite said convex direction;

said shape of said plate and said neck dimensioned in operable combination with said wheel to provide that said cover is securely positionable with said concave surface flush against said convex surface of said wheel and said neck is press fitted inside said shoulder;

said plate being a resilient metal alloy having a thickness selected from a range of thickness from 0.01 inches to 0.030 inches;

said plate having a plurality of apertures arranged in a circle concentrically around said neck region;

each aperture of said array of apertures has a shape selected from a group of shapes that consists of diamond, a circle, an oblong slot, a square, a rectangle, a gasket being a flat ring with an inside diameter and outside diameter having an adhesive composition coating both sides of said gasket;

said gasket arranged for positioning between said front surface of said wheel and said concave surface of said plate whereby security of said cover flush against said front surface of said wheel is enhanced.

6. A method for applying identifying markings on a skate board which includes the steps:

providing for each wheel of said skate board the cover of claim 5 wherein a design of said apertures is unique;

mounting one of said covers having said unique design on each wheel of said skateboard.

* * * * *